United States Patent [19]

de Brock

[11] Patent Number: 4,807,525

[45] Date of Patent: Feb. 28, 1989

[54] CONVEYOR PRESS

[76] Inventor: Raoul de Brock, Vogelzanglaan 16, B-6500 Kortrijk, Belgium

[21] Appl. No.: 24,818

[22] Filed: Mar. 12, 1987

[30] Foreign Application Priority Data

Mar. 14, 1986 [DE] Fed. Rep. of Germany ..... 3608487

[51] Int. Cl.[4] ..... D05B 5/06

[52] U.S. Cl. ..... 100/153; 100/154; 198/779; 425/371

[58] Field of Search ..... 100/151, 153, 154, 118; 425/371, 373; 198/779

[56] References Cited

U.S. PATENT DOCUMENTS 4,419,066 12/1983 Neuman ..... 425/371
4,449,448 5/1984 Stabler et al. ..... 100/153
4,714,015 12/1987 Stabler ..... 100/154

FOREIGN PATENT DOCUMENTS 654139 12/1962 Canada ..... 100/153
2061195 6/1972 Fed. Rep. of Germany ..... 100/154
3117778 11/1982 Fed. Rep. of Germany ..... 100/153
327433 1/1958 Switzerland .

*Primary Examiner*—Andrew M. Falik
*Attorney, Agent, or Firm*—Laubscher & Laubscher

[57] ABSTRACT

A conveyor press for applying a surface pressure to moving workpieces, such as wooden planks, rubber and plastic webs and the like, has at least one pressing band arranged to be pressed against a workpiece. A pressure plate applies a working pressure to an operating portion of the pressing band; a plurality of rolling bodies is arranged in the region of the pressure plate in frictional contact with the pressure plate and the pressing band and may be returned from an outlet end to an inlet end of the pressure plate. The rolling bodies are formed as roller assemblies; each includes a row of rollers assembled in a unit. The rollers are located in alignment with one another in a final position and are rotatable relative to one another.

40 Claims, 7 Drawing Sheets

FIG.12
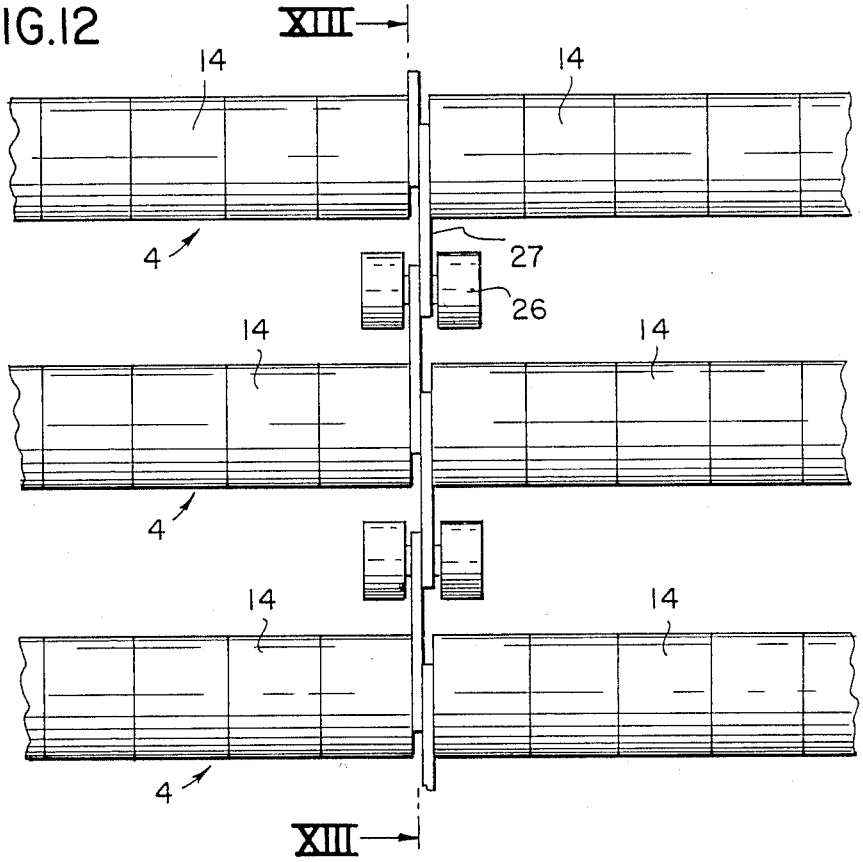
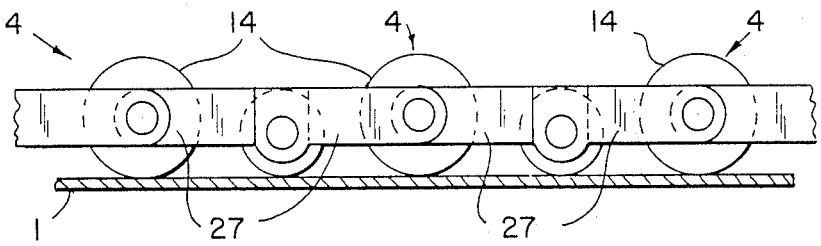
FIG.13

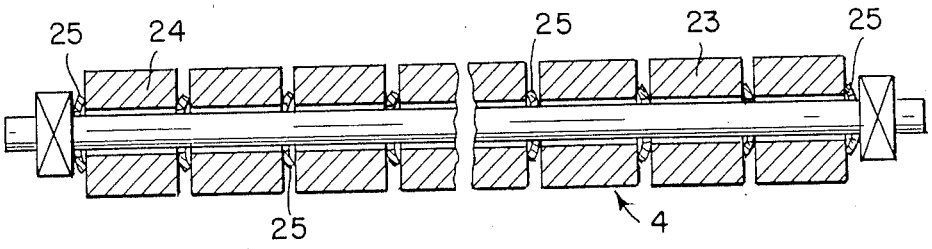
FIG.14
FIG.30a
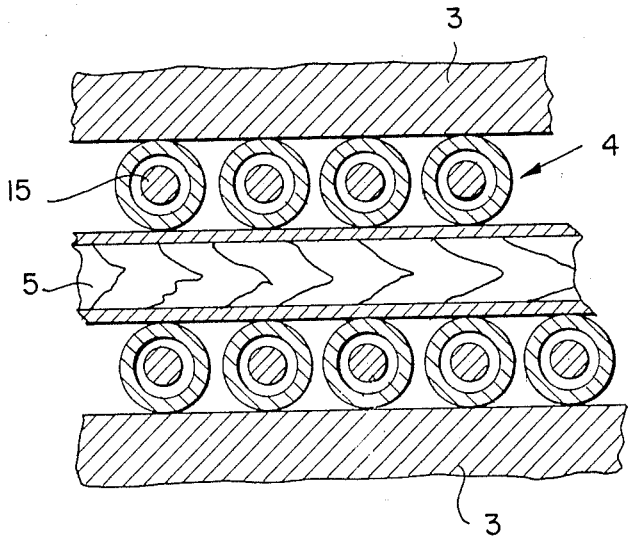
FIG.30b
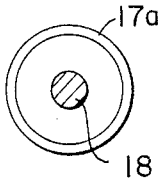

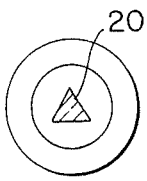
FIG. 30
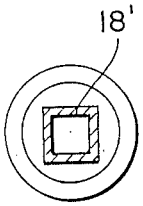
FIG. 27
FIG. 19
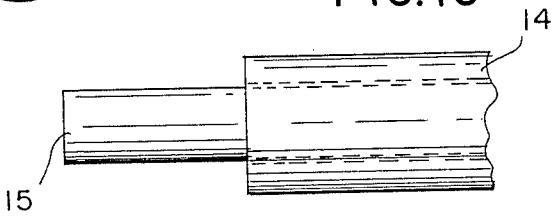
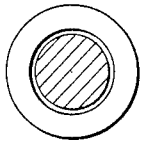
FIG. 20
FIG. 21
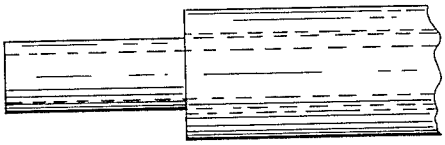
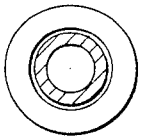
FIG. 22
FIG. 23
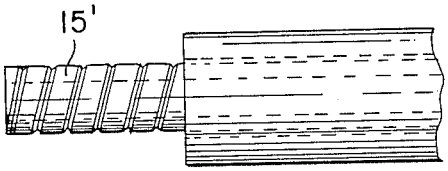
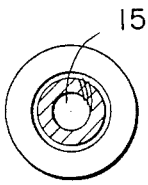
FIG. 24
FIG. 25
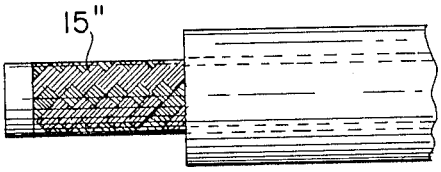
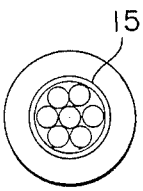
FIG. 26
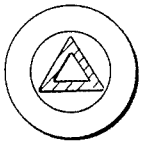
FIG. 29
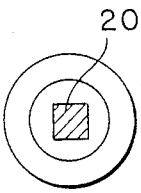
FIG. 28

CONVEYOR PRESS

BACKGROUND OF THE INVENTION

The present invention relates to an arrangement for applying a surface pressure to moving workpieces, such as wooden planks, rubber and plastic webs, etc.

More particularly, it relates to such an arrangement of the above type, which includes at least one rotatable pressing band which is pressed against a workpiece, a pressure plate which applies the working pressure to the operating travel of the pressing band, and a plurality of rolling bodies which are arranged in the region of the pressure plate at a distance from one another in frictional connection with the pressure plate and the associated operating travel of the pressing band, which extend over the whole width of the pressing band, and are transported back in a closed path from the outlet end of the pressure plate to the inlet end of the pressure plate.

A double-band press of this type is disclosed, for example, in the German document DE-OS No. 31 17 778. In this machine the rolling bodies arranged between the pressure plates and the pressing bands are formed as rolling rods. These rolling rods extend over the whole width of the machine which can amount to two or three meters, and have a diameter from fourteen to sixteen millimeters. Such an unfavorable length-/diameter ratio leads to a high torsion loading of the individual rolling rods or to a slippage of the rolling rods between the pressing band and the pressure plate which are generally made of steel sheets, and therefore to a premature wear. The rolling rods have diameter differences which can be caused by manufacturing tolerances, manufacturing inaccuracies, different heat expansion, etc. As a result of these diameter differences of the rolling rods, different points of the rolling rods have different angular speeds during rolling through a predetermined path in the pressing region. Therefore the rolling rods, in dependence on their diameter tolerances, are subjected to different torsion stresses distributed over their length.

For avoiding breakage of such rolling rods under the action of these torsion stresses, it is known to operate with small diameter tolerances, which should advantageously be for example lower than 10 micrometers. The manufacture of rolling rods with a length of over two meters and a diameter from fourteen to sixteen millimeters, with diameter tolerances under 10 micrometers, is very difficult and expensive. The high torsion of the rolling rods cannot be avoided even with relatively small manufacturing tolerances.

It should be mentioned that in addition to the diameter tolerances in the individual rolling rods, there are also further interfering or disturbing size deviations from one rolling rod to another. Together they lead to many difficulties.

SUMMARY OF THE INVENTION

Accordingly, it is an object of the present invention to provide an arrangement for applying a surface pressure to moving workpieces, which avoids the disadvantages of the prior art.

More particularly, it is an object of the present invention to provide an arrangement for applying a surface pressure to moving workpieces, which is designed so that different diameter tolerances over the length of the rolling bodies and different friction conditions in different points of the pressure plates and the pressing bands in cooperation with the rolling bodies do not negatively affect the service life and the proper operation of the rolling bodies.

In keeping with these objects and with others which will become apparent hereinafter, one feature of the present invention resides, briefly stated, in an arrangement of the above mentioned general type, in which each rolling body is formed as a row of rollers which directly border with one another and are assembled in a unit, which are in alignment with one another in a final position, and which are rotatable relative to one another. In accordance with another feature of the present invention, springs can be arranged at least between two neighboring rollers of the roller assembly. The springs can be supported correspondingly on the opposite end surfaces of two rollers.

Still another feature of the present invention is that the rollers which are rotatable in a roller assembly independently from one another, can be connected with one another in a form-locking and/or force-transmitting manner.

As long as the main axis of the individual roller assembly assumes a curved shape under existing operational conditions, the axes of rotation of the rollers form tangents to the main axis of the roller assembly.

The plurality of rollers in each roller assembly allows different angular and/or circumferential speeds of the rollers in partial regions formed by the rollers, without affecting the functional efficacy of the roller assemblies during the operation of the arrangement. In accordance with a further feature of the invention, with the use of the rollers which are formed as thin-walled sleeves and with the selection of a corresponding play between the sleeves and an axial rod extending through them, the sleeves can be elastically deformed in cooperation with the pressure plates and the pressing bands, so that the roller assemblies in the regions of individual sleeves can operate with different resilient action in a radial direction and provide optimal adjustment to operational conditions which locally differ from one another over the length of the roller assembly.

The resilient characteristic of the roller assembly and also the heat or cold transmission from the pressure plate to the pressing band can be influenced when the sleeves, in accordance with still a further feature of the invention, have different wall thickness and/or material.

An annular gap between the axial rod and the sleeves or rollers formed as hollow cylinders is further advantageous for the heating stream or cooling stream from the pressure plates to the pressing bands because of its insulating action. The axial rod is subjected to the action of the heating or cooling stream only to a small extent. Thereby the desired operational temperature of the pressing band is reached during heating or cooling of the pressure plate in a very short time.

In each roller assembly the rollers directly abut against one another without a separating gap. In this region, a trouble-free force transmission from the pressure plate to the pressing band takes place.

For increasing the safety and the service life of the arrangement, devices for rotation control of the sleeves can be associated with the roller assemblies. The rotation control can be performed in mechanical or electromagnetic manner. The blocking of a sleeve can be indicated at an end point of the axial rod and/or at a switch board, or can be used for activation of an emergency switch. The blocking of a sleeve can be traced to a remaining deformation of the sleeve, caused by a foreign member such as a screw which extends through the workpiece and acts upon the screw through the pressing band so as to deform the sleeve over the elasticity region.

The axial rod can be supported with ends thereof secured against rotation by flexible means connecting the roller assemblies to one another; the flexible means may be implemented as a link chain, as ropes, as wires or the like, or as tension springs. In the case of tension springs, the latter hold two respective roller assemblies together under tension.

In addition to the possibility of supporting the axial rod in a manner so as to be secured against rotation, according to a further inventive embodiment the axial rod may also be rotatably supported.

The novel features of the present invention are set forth in particular in the appended claims. The invention itself, however, both as to its construction and its manner of operation, will best be understood from the following description of preferred embodiments, which is accompanied by the following drawings.

BRIEF DESCRIPTION OF THE DRAWINGS

FIG. 12 is a view showing the arrangement and positioning of the roller assemblies;

FIG. 13 is a view showing a cross section of the arrangement of FIG. 12, taken along the line XIII—XIII, and FIG. 14 is a view showing a vertical section through the roller assembly in accordance with a further embodiment of the invention.

FIGS. 19 and 20 show a fragmentary elevation view, and a cross-section of an actual rod and sleeve;

FIGS. 21 and 22 are similar to FIGS. 19 and 20, except that the axial rod is hollow;

FIGS. 23 and 24 are similar to FIGS. 19 and 20, except that the axial rod is in the form of a wire;

FIGS. 25 and 26 are similar to FIGS. 19 and 20, except that the axial rod is in the form of a flexible cord;

FIG. 27 shows a cross-section of an axial rod surrounded by a sleeve, where the axial rod has a square cross-section of a pipe;

FIG. 28 is a cross-section of a sleeve and axial rod, where the rod has a square cross-section;

FIG. 29 is similar to FIG. 27, except that the pipe has a triangular cross-section;

FIG. 30 is similar to FIG. 28, except that the axial rod has a triangular cross-section;

Figure 1:
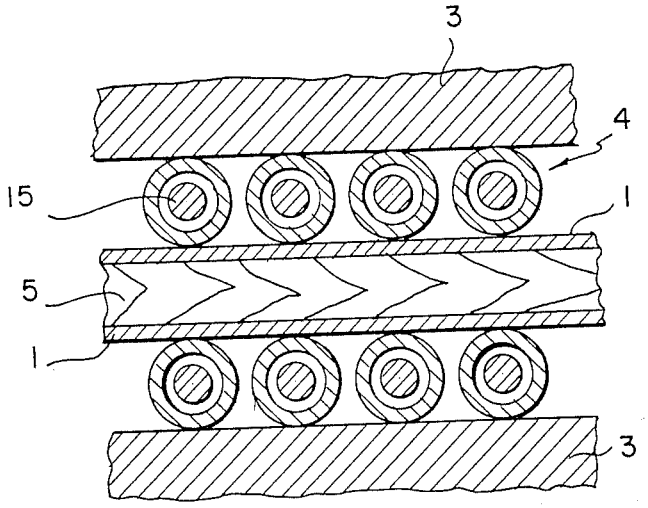
FIG. 1 is a view showing the region I of an arrangement for applying a surface pressure to moving workpieces shown in FIG. 2 on an enlarged scale.
Figure 7:
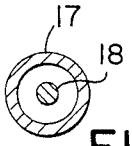
FIG. 7 is a section taken along the line VII—VII in FIG. 6.
Figures 31, 32, 33, 34:
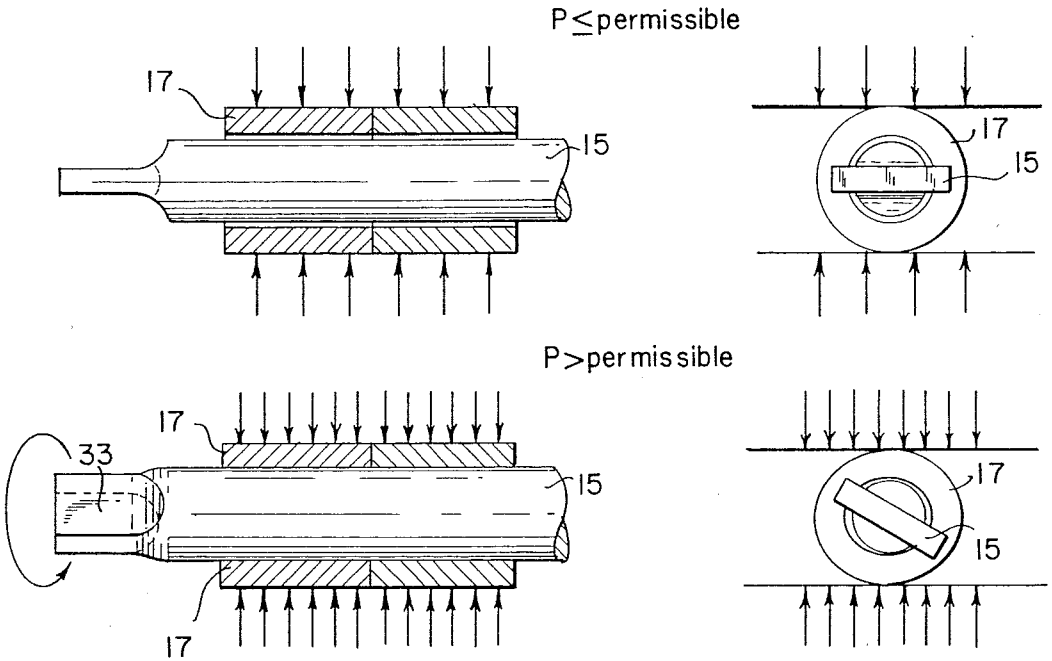

FIG. **30*a* is similar to FIG. 1**, except that neighboring roller strands are offset from one another;

FIG. **30*b* shows a cross-section of an axial rod and sleeve, where the sleeve has a different wall thickness than, for example, the wall thickness shown in FIG. 7**;

FIG. 31 is a fragmentary elevation view of a sleeve and axial rod, in cross-section, with normal pressure exerted on the sleeve;

FIG. 32 is a side elevation view of FIG. 31, with normal pressure exerted on the sleeve, there being no indication of turning at the end portion of the axial rod;

FIGS. 33 and 34 correspond to FIGS. 31 and 32, with a greater than normal pressure exerted on the sleeve, so as to show an indication of the axial rod turning.

DESCRIPTION OF PREFERRED EMBODIMENTS

Figure 2:
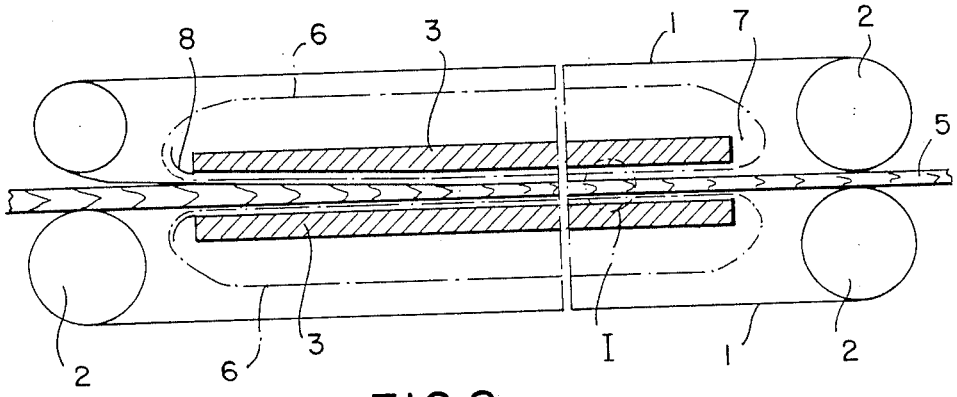
FIG. 2 is a view schematically showing the arrangement for applying a surface pressure to moving workpieces in a vertical section.

FIGS. 1 and 2 show the inventive arrangement for applying a surface pressure to moving workpieces, formed as a double-press. It has endless pressing bands which can be composed of steel sheets and guided over rerouting rollers 2. The rerouting rollers 2 are rotatably supported in a press frame, in which an upper and a lower pressure plate 3 are arranged.

Roller strands 4 are arranged between the pressure plates 3 and the associated operating portions of the pressing bands 1 at a distance from one another. The pressing forces produced by the pressure plates 3 are transmitted by the roller strands 4 to the operating portions of the pressing band 1. Workpieces 5 are guided between the operating portions of the pressing bands 1 through the double-press, and a surface pressure is applied to the workpieces.

The roller assemblies 4 can be arranged without connection with one another, or can be connected with one another by a flexible member 30, shown in FIGS. 15–18. They are guided in a known manner in the frame of the press over closed paths 6 which are identified by dash-dot lines in FIG. 2. The roller assemblies 4 are then returned from an outlet end 7 to an inlet end 8 of the pressure plates 3.

Figure 3:
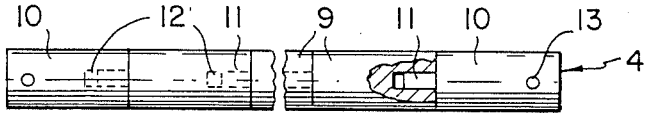
FIG. 3 is a view showing a roller assembly of the inventive arrangement, with individual rollers which are connected with one another in a form-locking and force-transmitting manner.

In the embodiment shown in FIG. 3, the roller assembly is composed of rollers 9 and cylindrical end pieces 10. The rollers 9 are rotatable relative to one another and relative to the cylindrical end pieces 10. They are form-lockingly connected with one another by means of a central pin 11 which is provided on the end side of the rollers, and a central recess 12 which is provided on the end side of the neighboring rollers and receives the corresponding pin.

The end pieces 10 also have on their inner end side the central recess 12 or the pin 11, so that the end pieces 10 are connected with the neighboring rollers in the same manner. The end pieces 10 can be provided with a through going opening 13 for a steel cord, for connecting the roller assemblies with one another. The steel cord forms a flexible connecting member for the individual roller assemblies.

Figure 5:
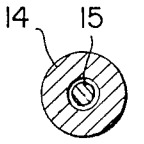
FIG. 5 is a sectional view along the line V—V in FIG. 4.
Figure 4:
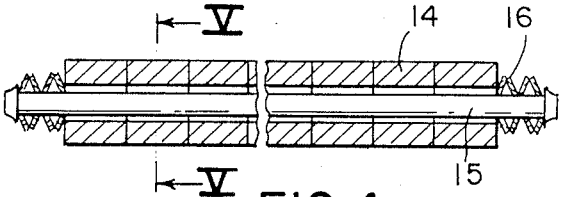
FIG. 4 is a vertical view showing the roller assembly in accordance with a further embodiment of the invention.

In the embodiment of FIGS. 4 and 5 the roller assembly is formed by hollow cylinders 14 which abut flush with their end sides against one another, have identical diameters, and are rotatably supported on an axial rod 15 with a small play. The axial rod 15 is prestressed and provided at the ends with a set of plate springs 16 which are supported on the corresponding outer end sides of the outer rollers. The prestressing of the axial rod 15 and arrangement of the plate spring sets at the ends of the axial rod provide for a force-transmitting pressing of the end surfaces of the hollow cylinders 14 against one another. Despite this force-transmitting arrangement, there is however the possibility that the hollow cylinders can rotate relative to each other. The sleeve 14 and rod 15 are shown in more detail in FIGS. 19 and 20. FIGS. 21 and 22 illustrate an alternate embodiment wherein the rod is hollow.

The force transmission between the individual rollers can be obtained by other spring means. For example, spiral springs 31 or hydropneumatic springs 32 can be utilized for t his purpose shown in FIGS. 15–17, and 18, respectively.

There is also the possibility to dispense with the arrangement of the springs at the ends of the axial rod and nevertheless to arrange the rollers on the axial rod moveably in an axial direction. In this case the rollers are assembled at the inlet end of the pressure plate symmetrically to the central line of the associated pressing band and for an end-side abutment.

Introduction of a respective pressure plate can be accomplished with the aid of guiding aid means, for example by means of a guide channel, or a guide opening, wherein the rollers or roller assemblies, which are situated outside the operating region may be laterally displaced, guided, or centered with respect to the corresponding associated pressing band.

Figure 6:
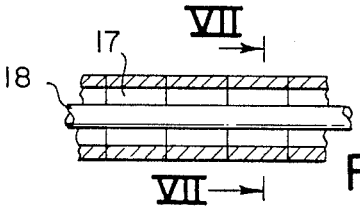
FIG. 6 is a vertical view showing the roller assembly in accordance with still a further embodiment of the invention.

In the construction of the roller assembly shown in FIGS. 6 and 7, the rollers are formed as sleeves 17 with a small wall thickness. They are arranged rotatably on an axial rod 18 with a relatively wide annular gap. The annular gap between the sleeves 17 and the axial rod 18 is selected so that the sleeves can be elastically deformed until their abutment against the axial rod 18. Thereby a row of elastic intermediate members are provided between the rigid pressure plates 3 and the pressing bands 1. These elastic intermediate members can act in an equalizing manner over the whole length of the roller assemblies and over individual regions of each roller strand.

Figure 8:
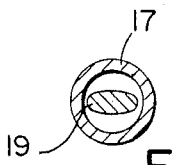
FIGS. 8, 9 and 10 are views showing further constructions of the roller assembly, in a cross section.

When a wide vertical play between the sleeves 17 and the axial rod is desired, but at the same time a relatively narrow guiding play in a horizontal direction must be provided, an axial rod 19 is formed with an oval cross section which is shown in FIG. 8. The sleeves 17 can be elastically deformed until their abutment against the associated limiting surfaces of the axial rod 19.

Figure 9:
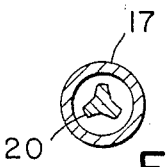

There is also the possibility of forming an axial rod 20 triangularly as 20' shown in FIG. 9, or with another 20'' geometrical form, for example square cross section 20 as shown in FIG. 28. In these cases or a triangular cross-section 20'', as shown in FIG. 30, it should be taken into account that after an elastic deformation of the sleeves which surrounds such axial rods, they must limit the deformability of the sleeves and thereby change the resilient characteristic of the roller assembly.

Figure 10:
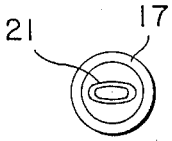

For influencing the total characteristic of the roller assembly, there is also the possibility of forming the axial rod as a pipe, such as an oval pipe 21 shown in FIG. 10, a round pipe, a triangular pipe 18'', as shown in FIG. 29, a square pipe 18', as shown in FIG. 27, or a pipe of another cross section.

The axial rod can also be formed in a different manner. For example, the axial rod can be composed of a wire 15', as shown in FIGS. 23 and 24, a strand 15'', as shown in FIGS. 25 and 26, a cord or another flexible member.

There is also the possibility to form the roller assemblies so that the end edges of the rollers of two roller assemblies which lie directly after one another are laterally offset relative to each other.

Figure 11:
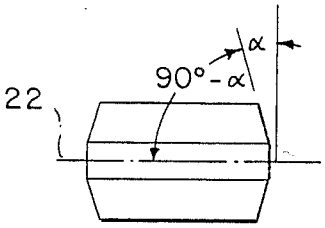
FIG. 11 is a view showing a roller formed as a hollow cylinder in the roller assembly, in longitudinal section.
Figure 15:
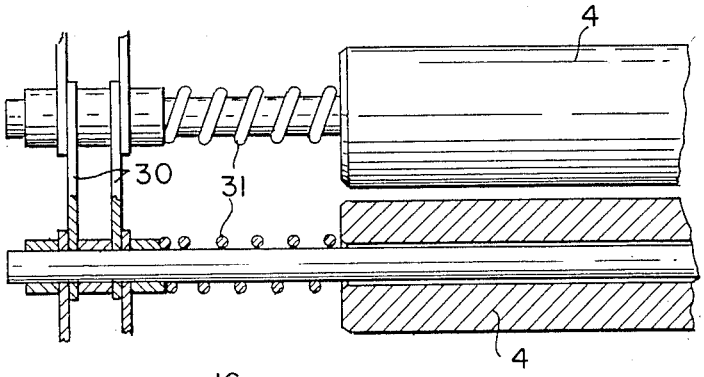
FIG. 15 is an elevation view of two juxtaposed rollers, and also showing compression springs.
Figure 16:
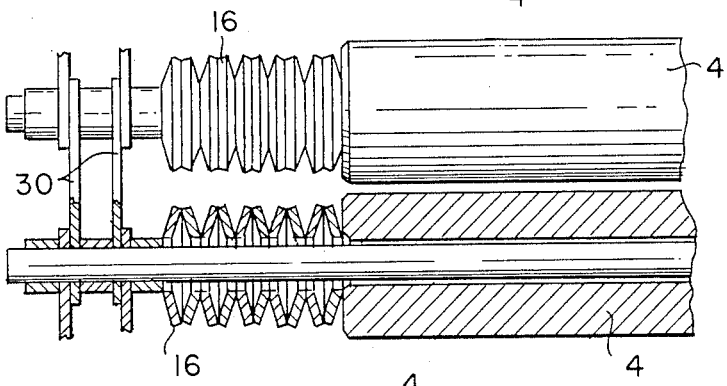
FIG. 16 is similar to FIG. 15, but showing plate-type of springs.
Figure 17:
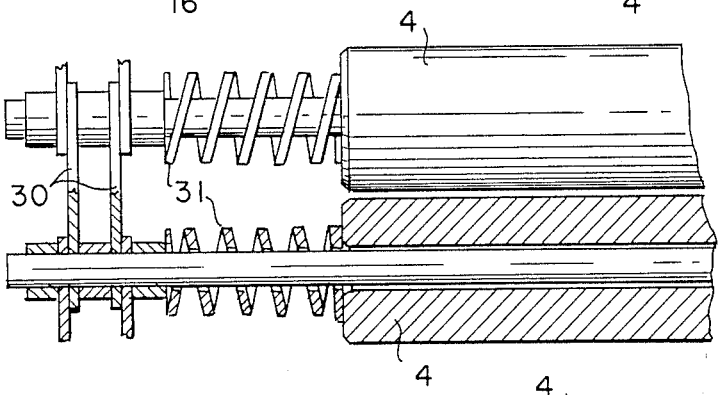
FIG. 17 is similar to FIG. 15, showing spiral springs.
Figure 18:
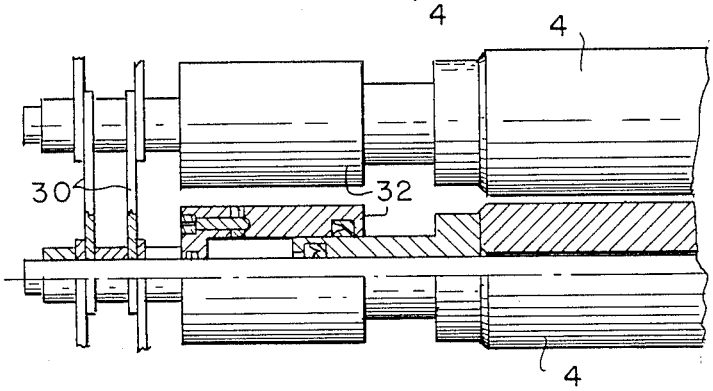
FIG. 18 is similar to FIG. 15, but showing hydropneumatic springs.

In the embodiment shown in FIG. 11, the pivotability of two neighboring rollers relative to one another is increased. This is achieved in that the end edges of the rollers are formed so that they form an angle with the axis of rotation 22. This angle is somewhat smaller than 90° and can lie in the region between 85° and 89°.

When the rollers of the roller assembly are formed as sleeves, and the sleeves at the ends of the axial rod are associated with a flexible abutment or arranged movably in an axial direction, the sleeves are allowed to move in a vertical direction within their elasticity region and also in an axial direction. Thereby they can take up in a resilient manner not only vertical loads, but also movements in an axial direction under the influence of heat expansion of the pressure bands which expand in a transverse direction.

The above described moveability of the roller assemblies in an axial direction is also used to take up in a gentle manner any loads which are produced during operation of the pressing bands.

The roller assemblies shown in FIGS. 12 and 13 are connected with one another in their respective approximately central regions by shackles 27 which are articulately fixed to one another. Several shackles 27 can connect two roller assemblies 4 in the form of a multilink chain. In this way a rerouting radius during the return transportation of the roller assemblies 4 from the outlet end of the pressure plate to its inlet end, can be kept advantageously small.

Supporting rollers 26 can be provided for supporting the shackles 27. They are arranged in the region of articulation between the shackles 27 and supported on the rear side of the pressing band 1.

The connection of the roller strands with each other respectively in the central region prevents wear of the hollow cylinders 14 by different loadings. This wear can otherwise lead to difficulties during transportation of the roller assemblies 4, particularly on a return run, which occur when the roller assembly 4 are supported on each side thereof.

FIG. 14 shows a further roller body in accordance with the present invention. This roller body is formed as a roller assembly 4 which has a row of hollow cylinders 23 assembled in a structural unit. Springs 25 are arranged between the hollow cylinders 23 which are aligned with one another in the final position and are rotatable relative to the neighboring roller bodies. The springs 25 abut against the opposite end faces of two hollow cylinders 23. The springs 25 are formed in this embodiment as plate springs and serve for resiliently taking up movement of the hollow cylinders 23 in an axial direction, so as to prevent any adding of pressure stresses.

In accordance with further features of the present invention, the axes of rotation of the rollers can form during the operation tangents to the main axis of the respective roller strands. The sleeves of the same roller strand can have different wall thicknesses and/or different materials. The axial rod can be supported at its end on a flexible member which connects the roller assemblies with one another, for joint rotation with this member. The axial rod can be rotatably arranged. FIGS. 31 and 32 show a sleeve 17 and an axial rod 15, with a permissible pressure being applied on sleeve 15, so that the axial rod 15 remains stationary, and FIGS. 33 and 34 show a sleeve 17 and a rod 15 with an excessive pressure being applied to sleeve 17, so that axial rod 15 is blocked and turns. Here the axial rod 15 has a visible end, and in the event of an excessive pressure being exerted on the axial rod, the rod 15 turns, the visible end showing an indication of the turning.

Furthermore, devices can be provided for controlling the rotation of the sleeves in a mechanical or electromagnetic manner. These devices can operate by indicating the blocking of a sleeve at one end point of the axial rod and/or at a switch, or by activating an emergency switch.

The present invention is not limited to the details shown, since various modifications and structural changes are possible without departing in any way from the spirit of the invention.

What is desired to be protected by Letters Patent is set forth in particular in the appended claims.

1. A conveyor press for applying a surface pressure to moving workpieces, such as wooden planks, rubber and plastic webs and the like, comprising at least one rotatable endless pressing band having a predetermined width and an operating portion arranged to be pressed against a workpiece;

a pressure plate arranged to apply an operating pressure to said operating portion of said endless pressing band and having an inlet end and an outlet end;

at least one roller assembly including a plurality of rollers located in a region of said pressure plate, spaced at a distance from one another, being in frictional contact with said pressure plate and said operating portion of said endless pressing band, said rollers extending substantially over the whole width of said endless pressing band;

means for continuously transporting said rollers in a closed path from said inlet end of said pressure plate to said outlet end of said pressure plate, including means for routing said endless rotatable pressing band from said inlet end of said pressure plate to said outlet end of said pressure plate and rerouting said endless rotatable pressing band from said outlet end of said pressure plate to said inlet end of said pressure plate; and wherein said rollers of each of said roller assemblies are arranged in an end-to-end abutting relationship with one another.

2. An arrangement as defined in claim 1, wherein said rollers of each of said roller assemblies are arranged in a form-locking connection with one another.

3. An arrangement as defined in claim 1, wherein said rollers of each of said roller assemblies are arranged in a force-transmitting connection with one another.

4. An arrangement as defined in claim 1, wherein said rollers of each of said roller assemblies are arranged in a form-locking and force-transmitting connection with one another.

5. An arrangement as defined in claim 1, wherein each of said roller assemblies has a main strand axis, each of said rollers having an axis of rotation, said rollers being arranged so that during operation said axes of rotation of said rollers form tangents to said main assembly axis of a respective of said roller assemblies.

6. An arrangement as defined in claim 1, wherein said rollers have end sides, and further comprising means for form lockingly connected said rollers of said respective assemblies with one another, said connecting means including a central pin arranged on one of said end sides of one of said rollers and a central recess provided on one of said end sides of a neighboring one of said rollers for receiving said central pin.

7. An arrangement as defined in claim 1; and further comprising an end side abutment associated with each of said roller assemblies, said pressing band having a central line, said rollers being arranged movably in an axial direction and assembled at said inlet end of said pressure plate symmetrically with respect to said center line of said pressing bands and with respect to said end side abutment.

8. An arrangement as defined in claim 1, wherein said roller assemblies include at least two neighboring roller assemblies formes so that said rollers of one of said two roller assemblies are laterally offset relative to said rollers of the other of said two roller assemblies.

9. A conveyor press for applying a surface pressure to moving workpieces, such as wooden planks, rubber and plastic webs and the like, comprising at least one rotatable endless pressing band having a predetermined width and an operating portion arranged to be pressed against a workpiece;

a pressure plate arranged to apply an operating pressure to said operating portion of said endless pressing band and having an inlet end and an outlet end;

at least one roller assembly including a plurality of rollers located in a region of said pressure plate, spaced at a distance from one another, being in frictional contact with said pressure plate and said operating portion of said endless pressing band, said rollers extending substantially over the whole width of said endless pressing band;

means for continuously transporting said rollers in a closed path from said inlet end of said pressure plate to said outlet end of said pressure plate, including means for routing said endless rotatable pressing band from said inlet end of said pressure plate to said outlet end of said pressure plate and rerouting said endless rotatable pressing band from said outlet end of said pressure plate to said inlet end of said pressure plate; and spring means arranged between at least two of said rollers of each of said roller assemblies, said two rollers having oppositely located end surfaces, said spring means abutting against said end surfaces of said two rollers.

10. A conveyor press for applying a surface pressure to moving workpieces, such as wooden planks, rubber and plastic webs and the like comprising at least one rotatable endless pressing band having a predetermined width and an operating portion arranged to be pressed against a workpiece;

a pressure plate arranged to apply an operating pressure to said operating portion of said endless pressing band and having an inlet end and an outlet end;

at least one roller assembly including a plurality of rollers located in a region of said pressure plate, spaced at a distance from one another, being in frictional contact with said pressure plate and said operating portion of said endless pressing band, said rollers extending substantially over the whole width of said endless pressing band;

means for continuously transporting said rollers in a closed path from said inlet end of said pressure plate to said outlet end of said pressure plate, including means for routing said endless rotatable pressing band from said inlet end of said pressure plate to said outlet end of said pressure plate and rerouting said endless rotatable pressing band from said outlet end of said pressure plate to said inlet end of said pressure plate;

wherein said rollers are formed as sleeves, each of said roller assemblies having an axial rod which rotatably supports said rollers of the same roller assembly; and wherein said sleeves have a small wall thickness and being rotatably supported on said axial rod with an annular gap between said sleeves and said axial rod.

11. An arrangement as defined in claim 10, wherein said rollers are formed as hollow cylinders which are rotatably supported on said axial rod with a relatively small play between said hollow cylinders and said axial rod.

12. An arrangement as defined in claim 10, wherein said annular gap has a predetermined width, said sleeves being elastically deformable over said width of said annular gap until they abut against said axial rod.

13. An arrangement as defined in claim 10, wherein said sleeves of a respective one of said roller assemblies have different respective wall thicknesses.

14. An arrangement as defined in claim 10, wherein said sleeves of a respective one of said roller assemblies are composed of different respective materials.

15. An arrangement as defined in claim 10, wherein said sleeves of a respective one of said roller assemblies have different respective wall thicknesses and are composed of different respective materials.

16. A conveyor press for applying a surface pressure to moving workpieces, such as wooden planks, rubber and plastic webs and the like, comprising at least one rotatable endless pressing band having a predetermined width and an operating portion arranged to be pressed against a workpiece;

a pressure plate arranged to apply an operating pressure to said operating portion of said endless pressing band and having an inlet end and an outlet end;

at least one roller assembly including a plurality of rollers located in a region of said pressure plate, spaced at a distance from one another, being in frictional contact with said pressure plate and said operating portion of said endless pressing band, said rollers extending substantially over the whole width of said endless pressing band;

means for continuously transporting said rollers in a closed path from said inlet end of said pressure plate to said outlet end of said pressure plate, including means for routing said endless rotatable pressing band from said inlet end of said pressure plate to said outlet end of said pressure plate and rerouting said endless rotatable pressing band from said outlet end of said pressure plate to said inlet end of said pressure plate;

wherein said rollers are formed as hollow rolling bodies, each of said roller assemblies having an axial rod which rotatably supports said rollers of the same roller assembly; and wherein said axial rod is prestressed; and further comprising means for prestressing said axial rod.

17. An arrangement as defined in claim 16, wherein said hollow rollers include outer rollers provided in each of said roller assemblies and having end sides, said axial rod having rod ends, said prestressing means including springs means arranged at said respective rod ends and abutting against said end sides of said outer rollers of a respective one of said roller assemblies.

18. An arrangement as defined in claim 16, wherein said spring means for prestressing said axial rod include plate springs.

19. An arrangement as defined in claim 16, wherein said spring means for prestressing said axial rod include spiral springs.

20. An arrangement as defined in claim 16, wherein said springs means for prestressing said axial rods include hydropneumatic springs.

21. A conveyor press for applying a surface pressure to moving workpieces, such as wooden planks, rubber and plastic webs and the like comprising at least one rotatable endless pressing band having a predetermined width and an operating portion arranged to be pressed against a workpiece;

a pressure plate arranged to supply an operating pressure to said operating portion of said endless pressing band and having an inlet end and an outlet end;

at least one roller assembly including a plurality of rollers located in a region of said pressure plate, spaced at a distance from one another, being in frictional contact with said pressure plate and said operating portion of said endless pressing band, said rollers extending substantially over the whole width of said endless pressing band;

means for continuously transporting said rollers in a closed path from said inlet end of said pressure plate to said outlet end of said pressure plate, including means for routing said endless rotatable pressing band from said inlet end of said pressure plate to said outlet end of said pressure plate and rerouting said endless rotatable pressing band from said outlet end of said pressure plate to said inlet end of said pressure plate;

wherein said rollers are formed as hollow rollers, each of said roller assemblies having an axial rod which rotatably supports said rolling bodies of the same roller assembly; and further comprising means for supporting said axial rod of said roller assemblies rotatably.

22. An arrangement as defined in claim 21, and further comprising flexible means connecting said roller assemblies with one another, said axial rod being supported at said ends on said flexible means for joint rotation therewith.

23. An arrangement as defined in claim 21, wherein said rollers are formed as elastically deformable sleeves rotatably supported in said axial rod so that a relatively small horizontal play and a relatively large vertical play exist between said axial rod and said sleeves, and said sleeves can be elastically deformed as a result of said vertical play until they abut against said axial rod.

24. An arrangement as defined in claim 21, wherein said axial rod of said roller assemblies has a round cross-section.

25. An arrangement as defined in claim 21, wherein said axial rod of said roller assemblies has a square cross-section.

26. An arrangement as defined in claim 21, wherein said axial rod of said roller assemblies has a triangular cross-section.

27. An arrangement as defined in claim 21, wherein said axial rod of said roller assemblies is formed as a pipe.

28. An arrangement as defined in claim 27, wherein said axial rod of said roller assemblies is formed as a pipe with a round cross-section.

29. An arrangement as defined in claim 27, wherein said axial rod of said roller assemblies is formed as a pipe with an oval cross-section.

30. An arrangement as defined in claim 27, wherein said axial rod of said roller assemblies is formed as a pipe with a square cross-section.

31. An arrangement as defined in claim 27, wherein said axial rod of said roller assemblies is formed as a pipe with a triangular cross-section.

32. A conveyor press for applying a surface pressure to moving workpieces, such as wooden planks, rubber and plastic webs and the like comprising at least one rotatable endless pressing band having a predetermined width and an operating portion arranged to be pressed against a workpiece;

a pressure plate arranged to apply an operating pressure to said operating portion of said endless pressing band and having an inlet end and an outlet end;

at least one roller assembly including a plurality of rollers located in a region of said pressure plate, spaced at a distance from one another, being in frictional contact with said pressure plate and said operating portion of said endless pressing band, said rollers extending substantially over the whole width of said endless pressing band, means for continuously transporting said rollers in a closed path from said inlet end of said pressure plate to said outlet end of said pressure plate, including means for routing said endless rotatable pressing band from said inlet end of said pressure plate to said outlet end of said pressure plate and rerouting said endless rotatable pressing band from said outlet end of said pressure plate to said inlet end of said pressure plate;

wherein said rollers are formed as hollow rolling bodies, each of said roller assemblies having an axial rod which rotatably supports said rolling bodies of the same roller assembly; and wherein said axial rod of said roller assemblies is formed as a flexible member.

33. An arrangement as defined in claim 32, wherein said axial rod of said roller assemblies is formed as a flexible wire.

34. An arrangement as defined in claim 32, wherein said axial rod of said roller assemblies is formed as a flexible strand.

35. An arrangement as defined in claim 32, wherein said axial rod of said roller assemblies is formed as a flexible cord.

36. A conveyor press for applying a surface pressure to moving workpieces, such as wooden planks, rubber and plastic webs and the like, comprising at least one rotatable endless pressing band having a predetermined width and an operating portion arranged to be pressed against a workpiece;

a pressure plate arranged to apply an operating pressure to said operating portion of said endless pressing band and having an inlet end and an outlet end;

at least one roller assembly including rollers located in a region of said pressure plate, spaced at a distance from one another, being in frictional contact with said pressure plate and said operating portion of said endless pressing band, said rollers extending substantially over the whole width of said endless pressing band;

means for continuously transporting said rollers in a closed path from said inlet end of said pressure plate to said outlet end of said pressure plate, including means for routing said endless rotatable pressing band from said inlet end of said pressure plate to said outlet end of said pressure plate and rerouting said endless rotatable pressing band from said outlet end of said pressure plate to said inlet end of said pressure plate; and wherein each of said rollers has an axis of rotation and end edges which are inclined to said axis of rotation at an angle which is somewhat smaller than 90°, so as to provide pivotability between two neighboring ones of said rollers of each of said roller assemblies.

37. An arrangement as defined in claim 36, wherein said angle between said end edges and said axis of rotation of said rollers is equal in operation to between 85° and 89°.

38. A conveyor press for applying a surface pressure to moving workpieces, such as wooden planks, rubber and plastic webs and the like, comprising at least one rotatable endless pressing band having a predetermined width and an operating portion arranged to be pressed against a workpiece;

a pressure plate arranged to apply an operating pressure to said operating portion of said endless pressing band and having an inlet end and an outlet end; and at least one roller assembly including a plurality of rollers located in a region of said pressure plate, spaced at a distance from one another, being in frictional contact with said pressure plate and said operating portion of said endless pressing band, said rollers extending substantially over the whole width of said endless pressing band;

means for continuously transporting said rollers in a closed path from said inlet end of said pressure plate to said outlet end of said pressure plate, including means for routing said endless rotatable pressing band from said inlet end of said pressure plate to said outlet end of said pressure plate and rerouting said endless rotatable pressing band from said outlet end of said pressure plate to said inlet end of said pressure plate; and wherein said roller assemblies have central regions, each two of said roller assemblies being connected with one another in said central regions, and further comprising roller assembly means for connecting each two of said roller assemblies with one another.

39. An arrangement as defined in claim 38, wherein said roller assembly connecting means includes two shackles each connected with a respective one of said two rollers and articulately connected with one another.

40. An arrangement as defined in claim 39, wherein said roller assembly connecting means further include a supporting roller provided between said two shackles and supported on said endless pressing band.

* * * * *

UNITED STATES PATENT AND TRADEMARK OFFICE

CERTIFICATE OF CORRECTION

PATENT NO. : 4,807,525

DATED : February 28, 1989

INVENTOR(S) : Raoul de Brock

It is certified that error appears in the above—identified patent and that said Letters Patent is hereby corrected as shown below:

In the Heading, Add:

Assignee: Firma Theodor Hymman
Bielefeld, West Germany

Signed and Sealed this

Fourteenth Day of November, 1989

*Attest:*

JEFFREY M. SAMUELS

*Attesting Officer* *Acting Commissioner of Patents and Trademarks*